US005850635A

United States Patent [19]

Lazarus

[11] Patent Number: 5,850,635

[45] **Date of Patent: *Dec. 22, 1998**

[54] PANEL INSERT FOR A SPORTS GLOVE WITH ASYMMETRICAL THUMB SEAM PATTERN

[75] Inventor: Alan H. Lazarus, Cincinnati, Ohio

[73] Assignee: Boyce-Lazarus Corporation, Cincinnati, Ohio

[ * ] Notice: The term of this patent shall not extend beyond the expiration date of Pat. Nos. 5,515,548 and 5,682,614.

[21] Appl. No.: 919,645

[22] Filed: Aug. 28, 1997

Related U.S. Application Data

[63] Continuation-in-part of Ser. No. 650,300, May 13, 1996, Pat. No. 5,682,614, which is a continuation-in-part of Ser. No. 236,119, May 2, 1994, Pat. No. 5,515,548.

[51] Int. Cl.[6] ..... A41D 19/00

[52] U.S. Cl. ..... 2/169

[58] Field of Search ..... 2/161.2, 161.1, 2/159, 163, 169; 112/418

[56] References Cited

U.S. PATENT DOCUMENTS

| | | | |
|---|---|---|---|
| 144,665 | 11/1873 | Foster | 2/169 |
| 174,764 | 3/1876 | Blanchard | 112/418 |
| 666,853 | 1/1901 | Morgan | 2/169 |
| 692,224 | 2/1902 | Baird | 2/169 |
| 956,156 | 4/1910 | Ornas | 2/169 |
| 975,289 | 11/1910 | Sachs | 2/169 |
| 1,220,524 | 3/1917 | McNeil | 112/418 |
| 1,252,900 | 1/1918 | Grinnell | 2/169 |
| 2,439,700 | 4/1948 | Simon | 112/418 |
| 3,151,334 | 10/1964 | Haupt et al. | 2/169 |
| 4,858,245 | 8/1989 | Sullivan et al. | 2/169 |
| 5,175,886 | 1/1993 | Suk | 2/161.2 |

*Primary Examiner*—Michael A. Neas
*Attorney, Agent, or Firm*—John M. Brandt

[57] ABSTRACT

An improvement in the construction of a sports glove having a thumb cross seam located on the back of the thumbnail covering portion and having a lateral seam located on the back of the thumb joining two thumb covering wing sections, the improvement comprising a panel of material inserted on the inner surface of the thumb bridging and attached to the wing sections to replace the lateral seam.

3 Claims, 1 Drawing Sheet

PANEL INSERT FOR A SPORTS GLOVE WITH ASYMMETRICAL THUMB SEAM PATTERN

CROSS REFERENCE TO RELATED APPLICATIONS

This application is a continuation in part of Ser. No. 08/650,300 filed May 13, 1996 now U.S. Pat. No. 5,682,614, which is a continuation in part of Ser. No. 08/236,119 filed May 2, 1994 now U.S. Pat. No. 5,515,548.

BACKGROUND OF THE INVENTION

1. Field of the Invention

The invention resides in the field of sports gloves and more particularly relates to an improvement in a glove with an asymmetrical thumb seam pattern.

2. Description of the Prior Art

The present invention is an improvement in the sports glove described in the above referenced patent as well as U.S. Pat. No. 5,515,548 issued May 14, 1996 to the same inventor. Those patents disclose a sports glove particularly suited for use while playing golf in which the thumb cross seam is positioned over the back of the thumbnail rather than at the tip; and the thumb lateral seam is positioned in the middle of the back of the thumb rather than at the sides.

The result of this design and method of construction is a glove with a better fit that is less intrusive or annoying to the wearer.

There is further disclosed in U.S. Pat. No. 5,175,886 issued to Suk, Jan. 5, 1993 a glove construction technique in which a portion of the back section of a thumb covering portion is removed to form a space or groove which is then overlaid with a panel of flexible material to enhance wearer comfort.

In contrast to the prior art, the present invention utilizes a panel of material to join and bridge rather than replaces a portion of the two wing sections which comprise the back of the thumb. These sections abut one another and as was previously disclosed in the above cited patents were joined by a lateral seam, preferably an inseam.

The present invention is an advance over the prior art in that the disclosed structure not only utilizes the fit improving features of the inventor's asymmetrical seam design but adds a measure of flexibility as well as visual enhancement to the finished glove.

SUMMARY OF THE INVENTION

The invention may be summarized as an improvement in a sports glove in which the top cross seam of the thumb covering unit is located on the back of the thumb unit and positioned, when in use, to lie over the thumbnail of the wearer. These gloves as previously disclosed were further constructed using a lateral seam positioned up the back of the thumb to join a unique pattern comprised of a palm portion and two adjacent wing portions. The lateral seam preferably an inseam, secured the two outermost edges of the wing portions.

The improvement disclosed herein consists of the addition of a panel of material inserted between the outermost edges of the wing portions of the completed thumb unit to form a bridge which allows the edges to flex apart. It has been found that this additional panel increases both the comfort and visual appearance of the finished glove.

The panel is preferably joined to each adjacent wing portion edge by a lap seam but other means of securing the three components, including inseams or even adhesives may be used as well.

Additionally, the panel may advantageously be comprised of a stretch fabric to further facilitate the conformity of the thumb unit to the wearer.

DESCRIPTION OF THE PRIOR ART

DESCRIPTION OF THE PREFERRED EMBODIMENT

Figure 1:
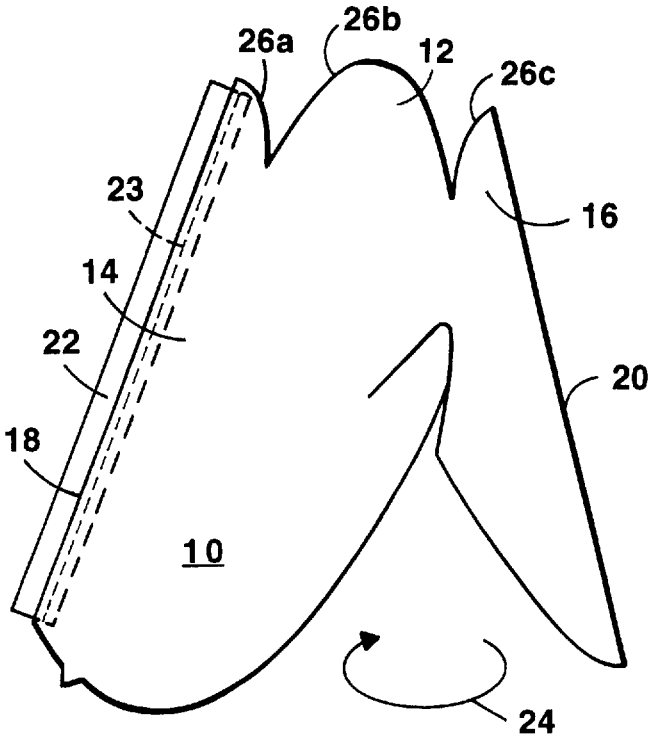
FIG. 1 is a plan view of a glove thumb pattern suitable for use in the preferred embodiment of the invention.

Referring to FIG. 1, there is shown a plan view of a glove thumb pattern used to construct the preferred embodiment of the invention. Pattern 10 consists of a central palm portion 12 which is of sufficient size to wrap around and form the sides of a finished thumb unit. Two opposed wing portions 14 and 16 are attached to and integral with central portion 12 and are of sufficient size in combination to form the entire back of the thumb.

Pattern 10 has additionally a strip of flexible material 22 attached by appropriate stitching 23 to either edge 18 of portion 14 or edge 20 of portion 16 prior to assembly. Strip 22 shown in FIG. 1 attached to edge 18 is secured to what will become the inner surface of pattern 10 when it is formed into a cylinder as indicated by arrow 24.

To complete the assembly strip 22 is attached to edge 20 in a manner similar to edge 8 by stitching 25 and the tip is closed with a cross seam 26 by attaching edges 26*a*, 26*b*, and 26*c*, again with appropriate stitching.

Figure 2:
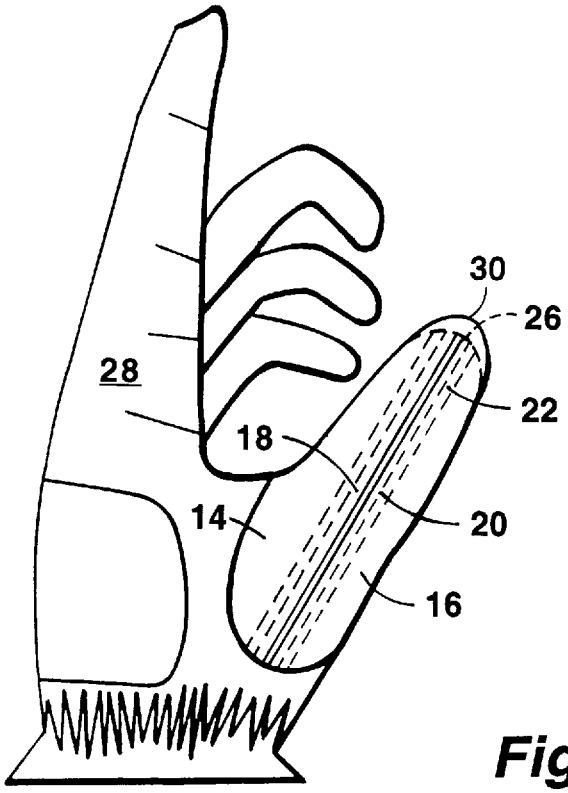
FIG. 2 is a plan view of the completed thumb of the pattern of FIG. 1.

The finished unit is shown in FIG. 2 further attached to a glove 28. As will be seem seam 26 is above the apex 30 of the thumb on the hand of the user and rests on the back of the thumbnail.

Figure 3:
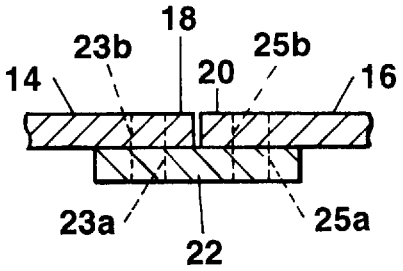
FIG. 3 is a cross sectional view showing the form of the seam utilized in the preferred embodiment of the invention.

In contrast to the prior art, edges 18 and 20 are not joined directly but are bridged by flexible strip 22 comprised of for example a man made fabric know as spandex sold as LYCRA or a similar material. This is illustrated more particularly in FIG. 3 where the forenamed components are joined by lap seams 23*a*, 23*b*, 25*a*, and 25*b*. As will be seen edges 18 and 20 are now free to separate within the confines of the flexibility of material 22 adding an additional degree of comfort as well as revealing the underlying decorative pattern of strip 22.

As variations in the above described construction might be made in order to obtain the same resulting configuration the invention is hereby defined by the following claims.

What is claimed is:

1. In a glove including a thumb unit comprised of:

A. A pattern having an inner surface and an outer surface comprised of:

1. a central palm portion arranged to cover the palm and two sides of said thumb when said pattern is sewn into a completed unit; and
2. two adjacent wing portions having side edges attached to each side of said palm portion each arranged to cover approximately one half the back of said thumb when said pattern is sewn into a completed unit, said unit formed in part by joining the top edges of said palm portion and said wing portion with a cross seam, said cross seam arranged to lie within that part of said back which when in use will cover the thumbnail of the wearer; the improvement which comprises the addition of a panel of flexible material inserted on the inner surface of said pattern positioned to bridge and join the side edges of said wing portions to complete the construction of said unit.

2. The thumb unit of claim 1 wherein said panel and said side edges are joined by lap seams.

3. The thumb unit of claim 1 wherein said flexible material is comprised of a stretchable fabric.

* * * * *